US008854405B2

(12) United States Patent
Nomura

(10) Patent No.: US 8,854,405 B2
(45) Date of Patent: Oct. 7, 2014

(54) PRINTER

(71) Applicant: Seiko Epson Corporation, Tokyo (JP)

(72) Inventor: Aiko Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/084,847

(22) Filed: Nov. 20, 2013

(65) Prior Publication Data

US 2014/0210937 A1 Jul. 31, 2014

(30) Foreign Application Priority Data

Jan. 30, 2013 (JP) ..... 2013-015200

(51) Int. Cl.
*B41J 11/00* (2006.01)

(52) U.S. Cl.
CPC ..... *B41J 11/0045* (2013.01); *B41J 11/0095* (2013.01); *B41J 11/0055* (2013.01)
USPC ..... 347/218

(58) Field of Classification Search
USPC ..... 347/218
See application file for complete search history.

(56) References Cited

U.S. PATENT DOCUMENTS 8,681,195 B2 * 3/2014 Matsushima ..... 347/171
2004/0234314 A1 * 11/2004 Tozaki et al. ..... 400/120.01

FOREIGN PATENT DOCUMENTS

JP 4637597 B2 2/2011

* cited by examiner

*Primary Examiner* — Huan Tran
(74) *Attorney, Agent, or Firm* — Nutter McClennen & Fish LLP; John J. Penny, Jr.

(57) ABSTRACT

A printer with excellent anti-static protection removes static electricity from the paper guide and recording paper and protects a paper detector from static. A printer 1 has a plastic frame 19 disposed facing the paper path A, and a stainless steel anti-static guard member 20 attached to the plastic frame 19 on one edge in the paper width direction X. The anti-static guard member 20 includes a protective plate 21 that shields the area around the detection unit 18*a* of a paper detector 18 from the paper path A; a paper guide 22 protruding from a side edge of the protective plate 21 to the paper path A side; and a ground part 24 connected to the protective plate 21 through a connecting part 23. The connecting part 23 and ground part 24 form a flat spring pressed against a case-side ground member 25.

7 Claims, 5 Drawing Sheets

PRINTER

BACKGROUND

1. Technical Field

The present invention relates to a printer that conveys recording paper through a paper path on which a paper detector is disposed.

2. Related Art

Portable, compact thermal printers are commonly used for printing receipts and labels. Such thermal printers have a paper guide unit that guides the conveyed recording paper to a thermal printhead. When the recording paper is conveyed, static electricity is caused by friction between the recording paper and the paper guide. A photosensor or other type of paper detector is typically disposed to the paper path. If charged recording paper passes near the paper detector, the paper detector can be adversely affected by the effects of static electricity.

Japan Patent 4637597 discloses technology that eliminates static electricity in a paper guide unit. The printer (duplex printing device) disclosed in Japan Patent 4637597 has a pair of left and right adjustable width guides (paper guide unit) that guide the left and right edges of the recording paper. These adjustable width guides are metal, and are disposed movably widthwise to the recording paper. When the gap between the left and right width guides is set to the maximum width, each of the width guides contacts a conductive coil spring on the respective side of the paper path, the width guides are thus grounded through the coil springs, and static electricity is eliminated.

Because the width guides (paper guide unit) are grounded in the configuration taught in Japan Patent 4637597, static electricity in the width guides can be removed and static electricity in the recording paper can be removed through the width guides. Wear resistance can also be assured because the width guides are metal. However, Japan Patent 4637597 is silent about problems in the paper detector caused by static electricity, and providing a member protecting the paper detector from static electricity near the paper detector is not addressed. The paper detector is therefore not sufficiently protected from static electricity, and the paper detector can malfunction due to static electricity.

SUMMARY

A printer according to the present invention with outstanding resistance to static electricity can remove static electricity from the paper guide unit and the recording paper and can protect the paper detector from static electricity.

A printer according to one aspect of the invention has a printhead; a paper feed mechanism that conveys recording paper through a paper path past the printhead; a paper detector that detects the recording paper on the paper path; and a conductive anti-static guard member having a protective plate portion that covers the area around the detection unit of the paper detector from the paper path side, a paper guide that protrudes from the protective plate portion toward the paper path and guides an edge of the recording paper at an edge position of the paper path in the paper width direction, and aground part that grounds the protective plate portion and the paper guide, the protective plate portion, the paper guide and the ground part being formed in unison.

The invention thus covers the area around the detection unit of a paper detector with a conductive protective plate, and this protective plate is formed in unison with a ground part. The paper detector can therefore be protected from static produced on the paper path side, and problems due to external electromagnetic waves can be suppressed. Because the paper guide, protective plate, and ground part are formed in unison, both the paper guide and the protective plate can be grounded, and static electricity can be removed from the paper guide and the recording paper P. More particularly, the paper guide can be constantly grounded because the paper guide and the ground part are formed as a single part. Anti-static protection is therefore excellent. Furthermore, both the paper guide and the protective plate that protects the paper detector can be installed and grounded by attaching a single member. The invention is therefore easy to assemble and conserves space.

Preferably, the anti-static guard member is made from stainless steel. This configuration can also improve the wear resistance of the paper guide disposed to the anti-static guard member.

Yet further preferably, the paper guide is a flat tab bent from an edge of the protective plate portion and extending toward the paper path side; the ground part is disposed to the distal end of a flat connecting part extending from an edge of the protective plate portion; and the thickness of the connecting part is less than the thickness of the flat tab. This configuration increases the thickness and assures the wear resistance of the paper guide, and assures good grounding by enabling the connecting part to flex easily.

Further preferably, the anti-static guard member is attached to a support member by an adhesive member; the connecting part renders a flat spring connected to the protective plate portion; and the elastic restoring force produced in the flat spring when the ground part is grounded is less than the adhesive strength of the adhesive member. This configuration enables easily affixing the anti-static guard member by an adhesive member. The adhesive member can also be prevented from detaching when the anti-static guard member is grounded, and separation of the anti-static guard member from the installed position can be suppressed.

In another aspect of the invention, the paper guide is a flat tab bent from an edge of the protective plate portion and extending toward the paper path side; the ground part is disposed to the distal end of a flat connecting part extending from an edge of the protective plate portion; and the connecting part and the ground part are cut in unison with the protective plate portion and the paper guide from stainless steel plate. The anti-static guard member is easily manufactured with this aspect of the invention.

Yet further preferably, the anti-static guard member is attached to a support member by an adhesive member, and when the connecting part renders a flat spring connected to the protective plate portion, the width and length of the connecting part are set so that the elastic restoring force produced in the flat spring when the ground part is grounded is less than the adhesive strength of the adhesive member. The elastic restoring force can thus be desirably set by adjusting the width and length of the connecting part without making the connecting part thin.

Yet further preferably, the protective plate portion is disposed facing the paper path, and has a detection window at a position exposing the detection unit; and the paper detector detects the recording paper on the paper path through the detection window. This aspect of the invention can cover the area around the detection unit with the protective plate, and thereby minimize the effect of static on the paper detector.

Effect of the Invention

The invention covers the area around the detection unit of a paper detector with a conductive protective plate, and can protect the paper detector from static produced on the paper path side because this protective plate is formed in unison with a ground part. In addition, because the paper guide, protective plate, and ground part are integrally formed, both the paper guide and the protective plate can be constantly grounded, and static electricity can be removed from the recording paper through the paper guide. Resistance to static electricity is therefore excellent.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures.

General Configuration

Figure 1:
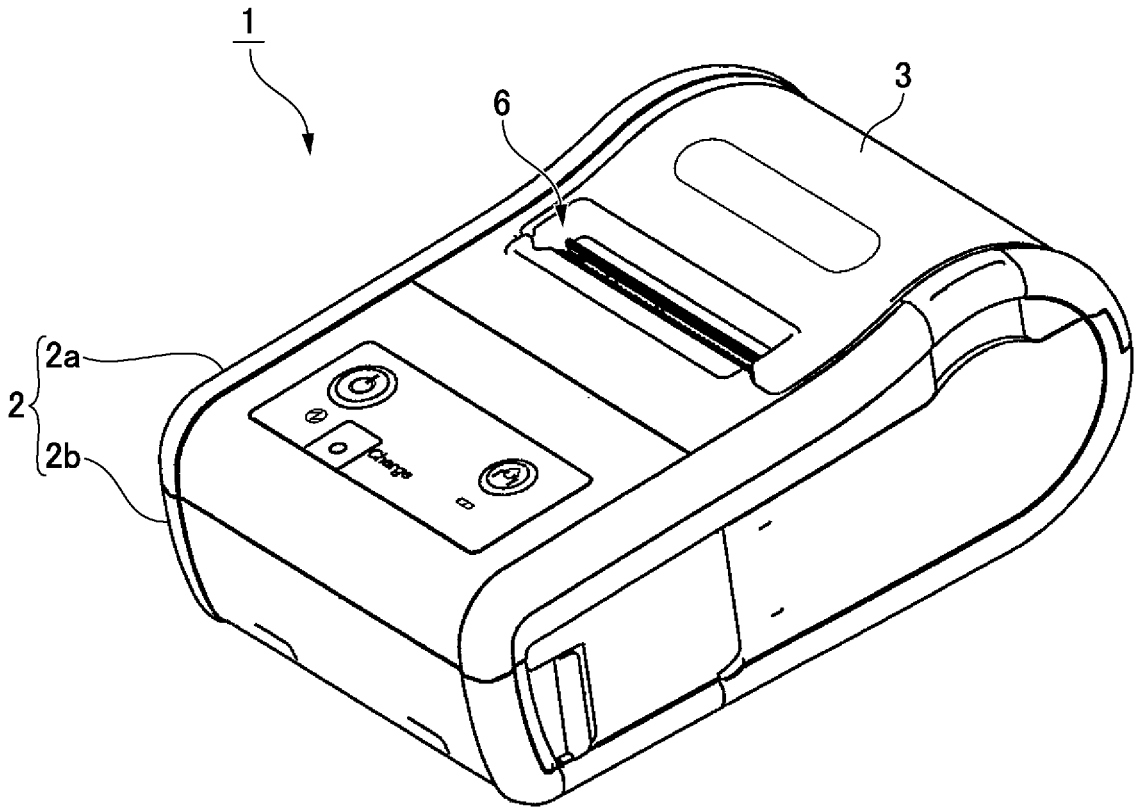
FIG. 1 is an external oblique view of a printer according to the invention with the access cover closed.
Figure 2:
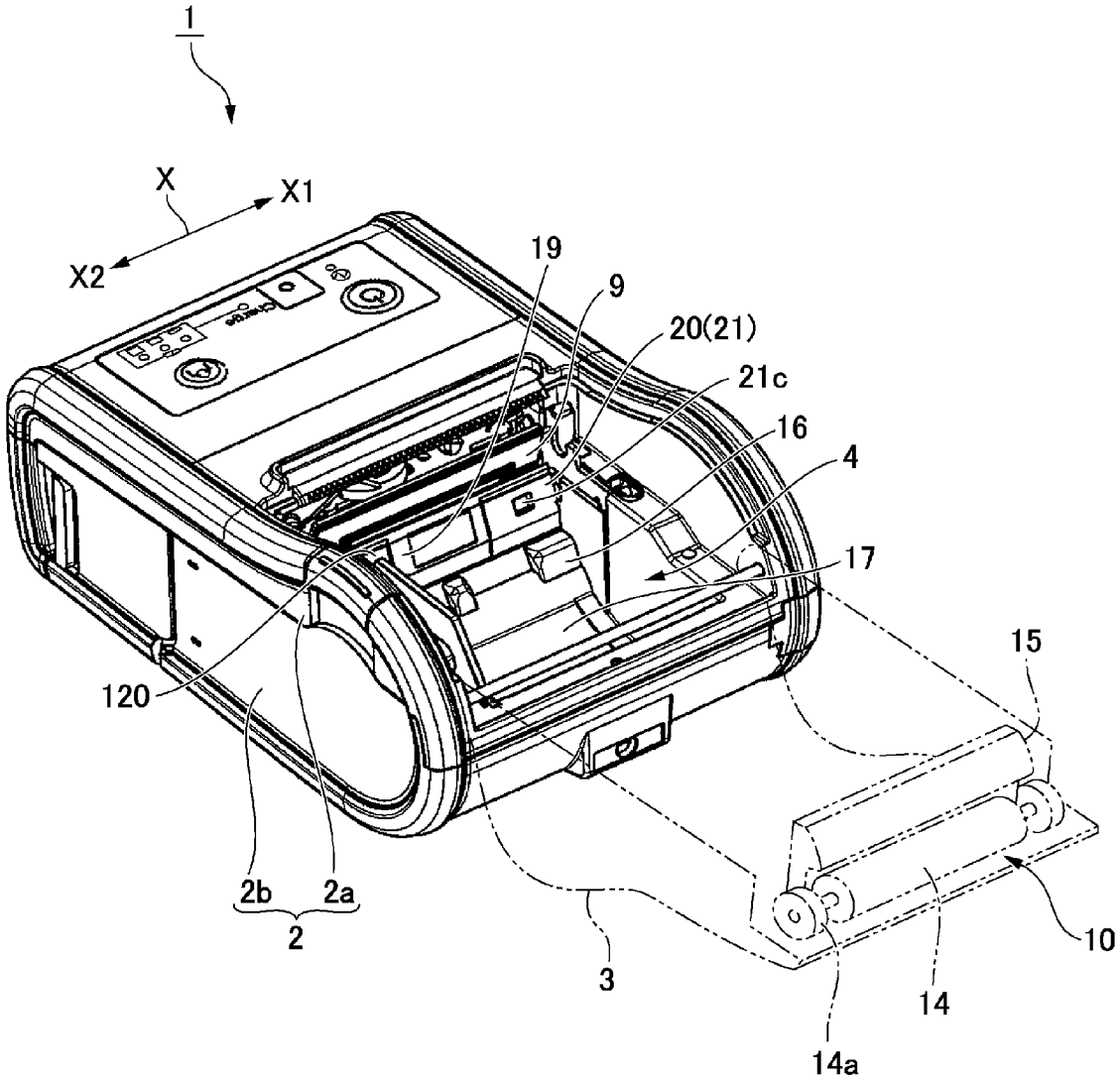
FIG. 2 is an external oblique view of a printer according to the invention with the access cover open.

FIG. 1 and FIG. 2 are oblique views of a printer according to this embodiment of the invention, FIG. 1 showing the printer with the access cover 3 closed, and FIG. 2 showing the printer with the access cover 3 open. Note that the outline of the access cover 3 is indicated by the imaginary line in FIG. 2. As shown in FIG. 1 and FIG. 2, the printer 1 is a compact portable printer. The printer 1 has an outside case 2 including a top case 2*a* and a bottom case 2*b*, and the access cover 3 is attached to the top case 2*a* to open and close. As shown in FIG. 2, opening the access cover 3 exposes the storage compartment 4 disposed below the access cover 3. A paper roll 5 (FIG. 4) of recording paper P (FIG. 4) wound into a roll is loaded in the storage compartment 4. The printer 1 is a thermal printer and uses thermal paper as the recording paper P. As shown in FIG. 1, a paper exit 6 is formed between the distal end of the access cover 3 and the top case 2*a* when the access cover 3 is closed.

Figure 3A:
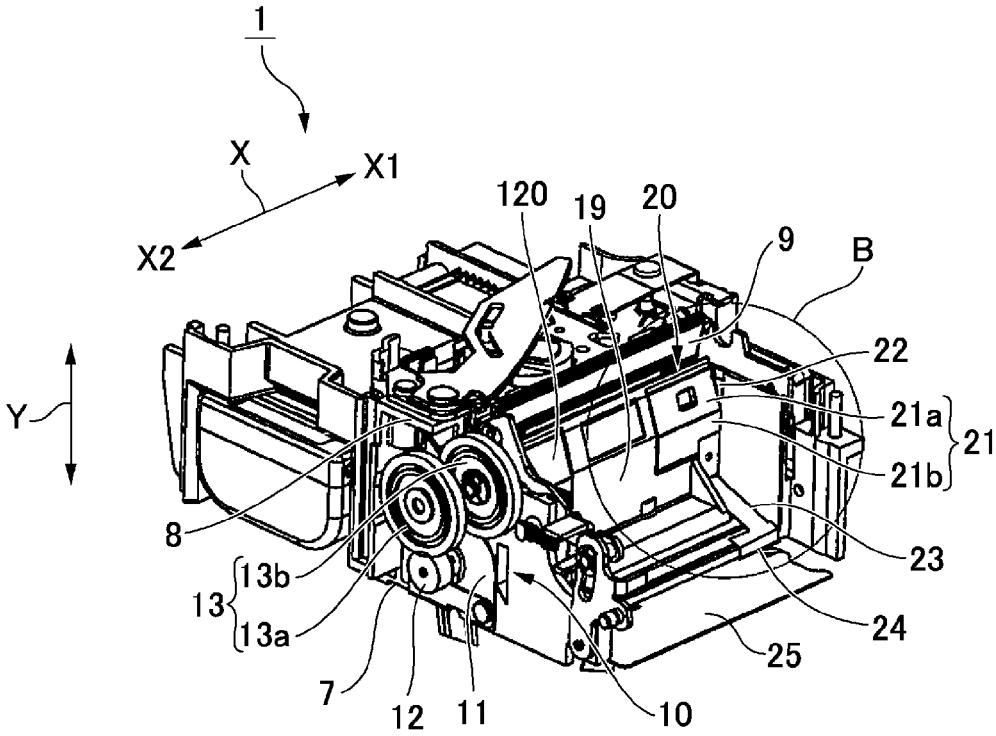
FIG. 3A is an oblique view showing the internal mechanism of the printer.
Figure 3B:
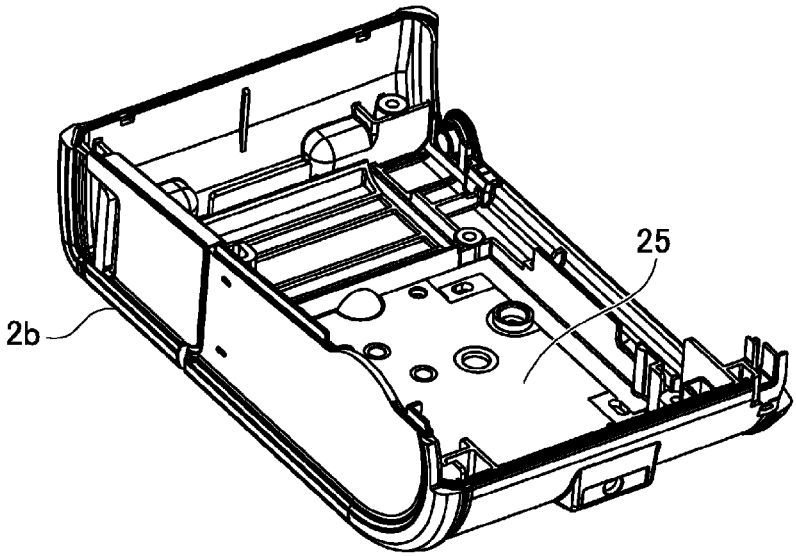
FIG. 3B is an oblique view showing the bottom case.

FIG. 3A is an oblique view showing the internal assembly of the printer 1, and FIG. 3B is an oblique view of the bottom case 2*b*. A main frame 7 and a head frame 8 that is supported by the main frame 7 are disposed inside the outside case 2. Parts constituting the internal mechanisms of the printer 1 are mounted on the main frame 7 and head frame 8. The printer 1 has a thermal head 9 (printhead) that prints on the recording paper P, and a paper feed mechanism 10 (see FIG. 2, FIG. 3) that conveys the recording paper P.

The paper feed mechanism 10 includes a paper feed motor 11 disposed on the bottom of the main frame 7, an output gear 12 attached to the output shaft of the paper feed motor 11, and a gear train 13 connected to the output gear 12. The gear train 13 includes spur gears 13*a*, 13*b*, and the bottom spur gear 13*a* meshes with the output gear 12. The paper feed mechanism 10 includes a platen roller 14 (FIG. 2) attached to the distal end part of the access cover 3, and a roller gear 14*a* (FIG. 2) attached to one end of the platen roller 14. Closing the access cover 3 meshes the roller gear 14*a* with the top spur gear 13*b*. As a result, drive power from the paper feed motor 11 is transferred through the gear train 13 to the platen roller 14.

The thermal head 9 is supported by the main frame 7 through the head frame 8. When the access cover 3 is closed, the thermal head 9 is positioned opposite the platen roller 14 attached to the distal end part of the access cover 3. When the access cover 3 is opened (FIG. 2), the recording paper P is pulled from the bottom side of the paper roll 5 placed in the storage compartment 4, and the recording paper P is set passing the thermal head 9 with the leading end coming out the top of the top case 2*a*. When the access cover 3 is then closed, the recording paper P is held between the thermal head 9 and the platen roller 14. The leading end of the recording paper P is also exposed on the outside of the top case 2*a* through the paper exit 6.

Figure 4:
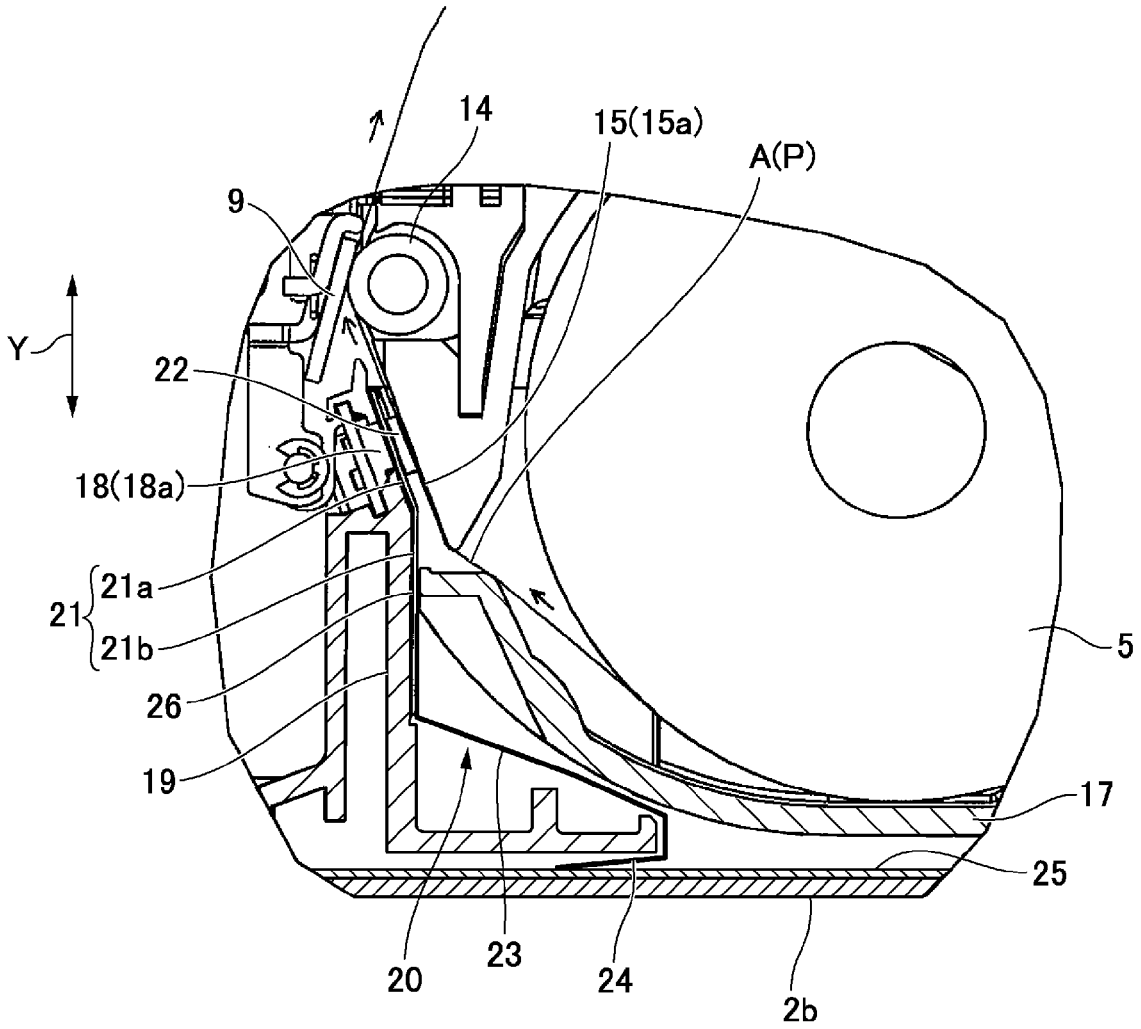
FIG. 4 is a section view of part of the paper path of the recording paper formed inside the printer when the access cover if closed.

FIG. 4 is a partial section view of the paper path A of the recording paper P formed inside the printer when the access cover 3 is closed. As shown in the figure, the recording paper P is delivered upward at an angle from the bottom of the paper roll 5, and is fed passing between the thermal head 9 and platen roller 14 through the paper path A to the paper exit 6. The thermal head 9 is urged to the platen roller 14 side by a spring not shown, and is pressed to the platen roller 14 with the recording paper P therebetween. When the paper feed motor 11 is then driven, the platen roller 14 turns and the recording paper P is conveyed. By causing the platen roller 14 to turn in conjunction with the thermal head 9 printing on the recording paper P, printing proceeds sequentially and the printed portion of the recording paper P is conveyed to and out the paper exit 6.

When the access cover 3 is closed, a top paper guide 15 and a bottom paper guide 16 are disposed below the thermal head 9 and platen roller 14. As shown in FIG. 2, the top paper guide 15 is mounted on the access cover 3 together with the platen roller 14. The bottom paper guide 16 is a protruding part disposed to the inside case 17 (FIG. 2, FIG. 4) defining the inside surface of the storage compartment 4. As shown in FIG. 4, the top paper guide 15 has a guide surface 15*a* that descends at an angle when the access cover 3 is closed. A paper detector 18 is disposed to detect recording paper P passing the portion of the paper path traveling diagonally upward along the guide surface 15*a*.

The paper detector 18 has a detection unit 18*a* opposite the guide surface 15*a*. The paper detector 18 is an optical sensor such as a reflective photosensor.

Anti-Static Guard Member

As shown in FIG. 2 and FIG. 4, the top part of a plastic frame 19 (support member) is formed protruding diagonally above the bottom paper guide 16 so that there is a specific gap to the guide surface 15*a*. As shown in FIG. 2, an anti-static guard member 20 made of stainless steel or other conductive metal is attached to the plastic frame 19 at one end in the paper width direction X (the side of arrow X1 in FIG. 2). A rectangular protective plate 21 of which the top part bends diagonally upward is disposed to the top end of the anti-static guard member 20. When the access cover 3 is open, the top parts of the plastic frame 19 and the protective plate 21 are exposed, and the bottom parts of the plastic frame 19 and protective plate 21 are covered by the inside case 17.

Figure 5:
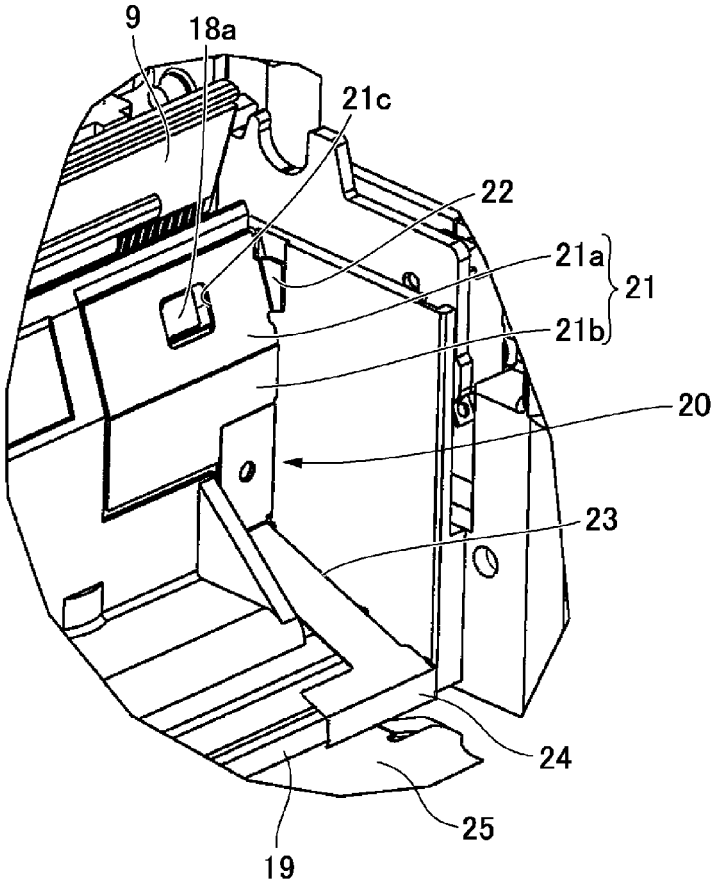
FIG. 5 is an enlarged view of area B in FIG. 3A.

FIG. 3A shows the bottom of the plastic frame 19 and anti-static guard member 20 with the inside case 17 removed. FIG. 5 is an enlarged view of area B in FIG. 3A. As shown in FIG. 4 and FIG. 5, the protective plate 21 has a top protective plate 21*a* that bends diagonally up, and a bottom protective plate 21*b* that extends straight down toward the bottom of the printer 1, exposed to the paper path A. The top protective plate 21*a* faces the guide surface 15*a*, and has a rectangular detection window 21*c* formed substantially in the middle of the top protective plate 21*a*. The detection window 21*c* is formed to a position superimposed with the detection unit 18*a* of the paper detector 18. The protective plate 21 covers the area around the detection unit 18*a* from the paper path A side. More specifically, the paper detector 18 is shielded from the paper path A except at the detection unit 18*a*, and is disposed so that recording paper P on the paper path A can be detected through the detection window 21*c*.

The anti-static guard member 20 has a paper guide 22 that protrudes from the side edge of the top protective plate 21*a* toward the paper path A. The paper guide 22 is more specifically located at the edge of the paper path A on one side of the paper width direction X (the side of arrow X1 in FIG. 2). This paper guide 22 guides the edge of the recording paper P passing through the paper path A, and determines the conveyance position of the recording paper P in the paper width direction X. The paper guide 22 is formed by bending a tab extending from one part of the side edge of the top protective plate 21*a* perpendicularly toward the paper path A. Because the anti-static guard member 20 is stainless steel, the wear resistance and durability of the paper guide 22 are excellent. The anti-static guard member 20 can obviously be made a different type of metal or other material that is conductive and has high wear resistance.

Figure 6:
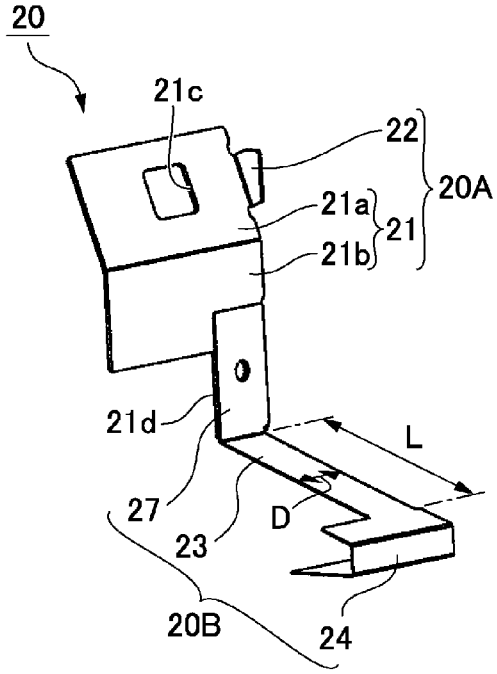
FIG. 6 is an oblique view of the electrostatic protection member.

FIG. 6 is an oblique view of the anti-static guard member 20. The protective plate 21 and paper guide 22 are formed in unison from stainless steel plate (thick plate 20A) of a uniform thickness. Another stainless steel panel (thin plate 20B) that is thinner than the thick plate 20A is welded to the bottom end of the bottom protective plate 21*b*. The anti-static guard member 20 is a single member made by welding the thin plate 20B to the thick plate 20A. In this example the thickness of the thick plate 20A is 0.3 mm, and the thickness of the thin plate 20B is 0.1 mm. The thickness of these panels is not limited to the foregoing, and the thickness of the thick plate 20A is simply preferably sufficient to assure the wear resistance of the paper guide 22. So that the anti-static guard member 20 can be positively grounded, the thickness of the thin plate 20B is set so that the thin plate 20B can be bent easily and appropriate elasticity can be achieved when shaped as a flat spring described below.

The thin plate 20B has a connecting part 23 that is narrower than the top part of the protective plate 21 in the paper width direction X, a ground part 24 disposed at the end (bottom end) of the connecting part 23, and a welding flange 27 at the top end of the connecting part 23. The welding flange 27 and the connecting part 23 are the same width. A welding flange 21*d* of the same width as the welding flange 27 is disposed to the bottom end of the bottom protective plate 21*b*. The welding flange 27 is welded onto the welding flange 21*d*. As a result, the thick plate 20A and the thin plate 20B are rendered in unison, and a single-piece anti-static guard member 20 having a protective plate 21, paper guide 22, and ground part 24 is formed. Note that a method other than welding (such as adhesive) can be used to bond the thick plate 20A and thin plate 20B together. Further alternatively, the entire anti-static guard member 20 could be manufactured from a single piece by cold forming.

The connecting part 23 bends to the storage compartment 4 side from the bottom end of the bottom protective plate 21*b* (that is, the bottom end of welding flange 21*d* and welding flange 27), and extends at a downward angle. The ground part 24 is wider than the connecting part 23 and is disposed to the distal end (bottom end) of the connecting part 23. The ground part 24 bends down and then bends back to the opposite side as the storage compartment 4. Because the ground part 24 thus bends in a trapezoidal shape when seen in section, it can deform elastically in the vertical direction Y of the printer 1. Because the width (dimension D in FIG. 6) of the connecting part 23 is narrower than the ground part 24 and protective plate 21 while its length (dimension L in FIG. 6; the direction perpendicular to the width) is longer and thickness is thinner, the connecting part 23 can flex easily in the vertical direction Y. More specifically, the connecting part 23 and ground part 24 form a flat spring that can deform elastically in the vertical direction Y.

As shown in FIG. 3B, a case-side ground member 25 made of copper foil or other conductive metal is disposed on the top side of the bottom of the bottom case 2*b*. As shown in FIG. 4, the bottom end part of the ground part 24 is inserted below the plastic frame 19, and the distal end (bottom end) contacts the case-side ground member 25. The anti-static guard member 20 is fastened to the plastic frame 19 through double-sided tape 26 (adhesive member) affixed to the back side of the protective plate 21. Because the bottom end of the ground part 24 is constrained by the case-side ground member 25 when the anti-static guard member 20 is fastened to the plastic frame 19, the flat spring formed by the connecting part 23 and ground part 24 is compressed in the vertical direction Y. The bottom end of the ground part 24 is thus pressed against the case-side ground member 25 by the elastic restoring force of the flat spring.

The shape of the flat spring is determined in this embodiment so that when the ground part 24 is grounded (that is, when the ground part 24 is pressed against the case-side ground member 25), the elastic restoring force (more specifically, the force pressing the ground part 24 against the case-side ground member 25) produced by the flat spring formed by the connecting part 23 and ground part 24 is reliably less than the adhesive strength of the double-sided tape 26. A desirable flat spring configuration can be achieved by appropriately adjusting the thickness, width, and length of the connecting part 23. As a result, the anti-static guard member 20 can be reliably grounded, and the double-sided tape 26 can be prevented from peeling and the anti-static guard member 20 separating from its attached position. Note that the adhesive member is not limited to double-sided tape 26, and other adhesive members can be used.

An anti-static guard member 120 is also attached to the plastic frame 19 on the other side in the paper width direction X (the side of arrow X2 in FIG. 2). The anti-static guard member 120 is shaped symmetrically to the anti-static guard member 20 referenced to a line perpendicular to the paper width direction X and passing through the center of the paper path A in the paper width direction X, but does not have a window such as the detection window 21*c* because a paper detector is not disposed to a symmetrical position. The anti-static guard member 120 has a paper guide (not shown in the figure) disposed to a position on the opposite side in the paper width direction X (the side of arrow X2 in FIG. 2). This paper guide together with the paper guide 22 disposed to the anti-static guard member 20 control where the edges of the recording paper P in the paper width direction X pass through the paper path A. The anti-static guard member 120 also has a ground part (not shown in the figure) that contacts the case-side ground member 25 in the same way as the anti-static guard member 20, and eliminate static produced by friction with the recording paper P.

As described above, the printer 1 according to this embodiment of the invention covers the area around the detection unit 18*a* of the paper detector 18 with a protective plate 21, and this protective plate 21 is formed in unison with a ground part 24. The paper detector 18 can therefore be protected from static produced on the paper path A side, and problems caused by external electromagnetic waves can be suppressed. A paper guide 22 guides the recording paper P on the paper path A, and the paper guide 22, protective plate 21, and ground part 24 are integrally formed together. As a result, grounding the ground part 24 grounds both the protective plate 21 and the paper guide 22, static electricity can be removed from the paper guide 22 and recording paper P. Electrostatic resistance is therefore excellent. Both a paper guide 22 and a protective plate 21 that protects the paper detector 18 can be provided and grounded by installing a single member (anti-static guard member 20), and an easily assembled, space-saving configuration can be achieved.

The ground part 24 in the foregoing embodiment is shaped to deform elastically in the vertical direction Y, but the ground part 24 can be rendered with a shape that does not deform elastically in the vertical direction Y. Only the narrow, flexible connecting part 23 functions as a flat spring in this configuration, but by appropriately setting the width, length, and thickness of the connecting part 23, the ground part 24 can be pressed against the case-side ground member 25 with elastic restoring force that does not peel the double-sided tape 26 when the ground part 24 is grounded as described above.

The thickness of the connecting part 23 is thinner than the protective plate 21 and paper guide 22 in the foregoing embodiment, but all parts of the anti-static guard member 20 could have the same thickness. For example, the protective plate 21, paper guide 22, connecting part 23, and ground part 24 could all be cut at once from the same stainless steel plate, and the anti-static guard member 20 shaped by bending the cut workpiece. A welding step is eliminated by this process, and the anti-static guard member 20 can be easily manufactured. When the thickness of the connecting part 23 is the same as the thickness of the protective plate 21 and paper guide 22, flexibility comparable to that described above can be achieved by making the width D of the connecting part 23 less and the length L of the connecting part 23 longer than described above. More specifically, even if the thickness of the connecting part 23 is the same as the paper guide 22, the width D and length L of the connecting part 23 can be adjusted so that when the ground part 24 is grounded, the elastic restoring force produced by the flat spring rendered by the connecting part 23 and ground part 24 is reliably less than the adhesive strength of the double-sided tape 26.

The protective plate 21 is disposed to completely cover the area around the detection unit 18*a* of the paper detector 18 in the foregoing embodiment, but the protective plate 21 could be shaped to cover only part of the area around the detection unit 18*a*.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a printhead;

a paper feed mechanism that conveys recording paper through a paper path past the printhead;

a paper detector that detects the recording paper on the paper path; and a conductive anti-static guard member having a protective plate portion that covers the area around the detection unit of the paper detector from the paper path side, a paper guide that protrudes from the protective plate portion toward the paper path and guides an edge of the recording paper at an edge position of the paper path in the paper width direction, and a ground part that grounds the protective plate portion and the paper guide, the protective plate portion, the paper guide and the ground part being formed in unison.

2. The printer described in claim 1, wherein:

the anti-static guard member is made from stainless steel.

3. The printer described in claim 1, wherein:

the paper guide is a flat tab bent from an edge of the protective plate portion and extending toward the paper path side;

the ground part is disposed to the distal end of a flat connecting part extending from an edge of the protective plate portion; and the thickness of the connecting part is less than the thickness of the flat tab.

4. The printer described in claim 3, wherein:

the anti-static guard member is attached to a support member by an adhesive member;

the connecting part renders a flat spring connected to the protective plate portion; and the elastic restoring force produced in the flat spring when the ground part is grounded is less than the adhesive strength of the adhesive member.

5. The printer described in claim 1, wherein:

the paper guide is a flat tab bent from an edge of the protective plate portion and extending toward the paper path side;

the ground part is disposed to the distal end of a flat connecting part extending from an edge of the protective plate portion; and the connecting part and the ground part are cut in unison with the protective plate portion and the paper guide from stainless steel plate.

6. The printer described in claim 5, wherein:

the anti-static guard member is attached to a support member by an adhesive member;

the connecting part renders a flat spring connected to the protective plate portion; and the width and length of the connecting part are set so that the elastic restoring force produced in the flat spring when the ground part is grounded is less than the adhesive strength of the adhesive member.

7. The printer described in claim 1, wherein:

the protective plate portion is disposed facing the paper path, and has a detection window at a position exposing the detection unit; and the paper detector detects the recording paper on the paper path through the detection window.

* * * * *